United States Patent [19]

Campbell

[11] 4,304,361

[45] Dec. 8, 1981

[54] BAGASSE PROCESS AND PRODUCT

[76] Inventor: George E. Campbell, 3053 Fairway Dr., Baton Rouge, La. 70809

[21] Appl. No.: 95,787

[22] Filed: Nov. 19, 1979

[51] Int. Cl.[3] ..... B02C 13/286

[52] U.S. Cl. ..... 241/24; 241/28; 241/81

[58] Field of Search ..... 19/7, 90, 94, 95; 241/57, 60, 16, 19, 24, 27, 28, 30, 73, 81, 189 R

[56] References Cited

U.S. PATENT DOCUMENTS

| | | | |
|---|---|---|---|
| 1,193,652 | 7/1877 | Harrison | 241/81 X |
| 1,501,925 | 7/1924 | Shaw | 71/26 |
| 1,876,522 | 9/1932 | Vazquez | 19/90 X |
| 2,723,194 | 11/1955 | Birdseye | 92/1 |
| 2,729,856 | 1/1956 | Horton et al. | 241/28 X |
| 2,729,858 | 1/1956 | Horton et al. | 19/90 |
| 2,760,234 | 8/1956 | Freeman | 19/90 X |
| 3,102,364 | 9/1963 | Pullen | 47/73 X |
| 3,163,517 | 12/1964 | May et al. | 71/26 |
| 3,241,587 | 3/1966 | Steele | 241/28 |
| 3,337,326 | 8/1967 | May et al. | 71/26 |
| 3,572,593 | 3/1971 | Guarisco | 241/24 |

*Primary Examiner*—Mark Rosenbaum

*Attorney, Agent, or Firm*—Lane, Aitken, Kice & Kananen

[57] ABSTRACT

A process for reducing sugarcane bagasse to a peat moss-like material that is useful as a planting or potting soil consists of the steps of: (1) screening the bagasse to remove the short fibers which are about $\frac{1}{4}$ to $\frac{3}{8}$ inch (6.35–9.53 mm) in length; (2) feeding the so-screened bagasse through a hammermill to reduce the remaining long fibers to fibers of a shorter length; and, (3) removing the short fibers which are about $\frac{1}{4}$ to $\frac{3}{8}$ inch (6.35–9.53 mm) in length as they are generated in the hammermill. The product consisting essentially of short fibers of bagasse which are about $\frac{1}{4}$ to $\frac{3}{8}$ inch (6.35–9.53 mm) in length produced by the foregoing process.

5 Claims, 3 Drawing Figures

BAGASSE PROCESS AND PRODUCT

BACKGROUND OF THE INVENTION

1. Field of the Invention

This invention is in the field of processing sugarcane bagasse into useful products.

Sugarcane stalks consist of an outer sheath-like portion composed of longitudinally extending fibers of varying lengths and a pithy center portion. The number of fibers in the stalk diminishes as the distance from the outer surface to the interior of the stalk increases. In the last decade, the cane has been genetically improved to provide a tougher stalk exterior to diminish the likelihood of penetration by boring insects (e.g., cane boring insects).

The sugarcane is cut in the field and then usually fed through a series of large crushing or milling rollers in the sugar mill to crush the stalks and extract the sugar-containing juice. The crushed, split stalks, known as bagasse, is the residue left after the juice has been extracted. The bagasse is usually piled in a field and left to decompose as a practically worthless by-product. As the bagasse leaves the last grinding mill in the sugar factory, it resembles crushed corn stalks with the individual fibers in the stalks ranging in length up to about 12 inches. The bagasse is occasionally used as a fuel for furnaces but this use is somewhat limited because of its high moisture content. Bagasse is also used sometimes as a worm bedding material by red worm growers. Since the fibers of the bagasse are quite hard, efforts to reduce the bagasse by cutting have not been successful because of cutting blade wear.

2. Description of the Prior Art

In the past, many inventors have worked on methods of processing bagasse in order to convert it into something useful. The following patents are illustrative of the prior efforts.

U.S. Pat. No. 1,876,522 to Vazquez describes a process of immersing bagasse in a solution of lime to loosen and separate the fibers. The fibers are then used in the manufacture of wall-board and paper products.

There are a number of known ways of separating the bagasse pith from the bagasse fibers. Some of these separating means are mechanical, some are chemical, while still others are a combination of mechanical and chemical separating means. Examples of the mechanical means which have been employed to separate bagasse pith from bagasse fiber can be found in U.S. Pat. Nos. 2,729,856 and 2,729,858, issued to Horton et al which describe a hammermill using water jets for processing bagasse to separate the bagasse into two portions, one which is substantially pith-free and the other which contains a major portion of the original pith. Other methods and apparatus for separating the pith from the fiber can be found in U.S. Pat. Nos. 2,723,194; 2,760,234; and 1,501,925.

U.S. Pat. No. 3,102,364 to Pullen describes transplanter pot compositions comprising bagasse pith, a cellulosic fibrous material (preferably digested bagasse fiber) and one or more of the following materials: *Tillandsia usneoides* (Spanish moss), a wet strength resin and a fungicide.

U.S. Pat. No. 3,163,517 to May et al discloses a method of preparing a soil conditioning composition from sugarcane bagasse which consists of weathering the bagasse, dehydrating it, classifying the weathered dehydrated bagasse, and adding inorganic plant nutrient chemicals.

U.S. Pat. No. 3,241,587 to Steele describes a hammermill-type of disintegrator for comminuting vegetal materials, such as sugarcane, by force feeding the vegetal material into the disintegrating zone, reducing the feed mass to a finely divided, substantially homogenous mass, and then extruding the mass through large apertures in a screen.

Finally, U.S. Pat. No. 3,337,326 also to May et al discloses another method of producing a soil conditioning composition consisting of compressing the sugarcane bagasse into bales, weathering the bales, comminuting the weathered bagasse, adding water to the bagasse, again weathering the bagasse in compacted piles, and adding inorganic plant nutrient chemicals.

SUMMARY OF THE INVENTION

The invention is a process for converting or reducing sugarcane bagasse and the resulting product which is a peat moss-like material useful as a planting or potting soil.

The process consists of three steps. First, screening the bagasse to remove short fibers which are about $\frac{1}{4}$ to $\frac{3}{8}$ inch (6.35 to 9.53 mm) in length.

Second, feeding the so-screened bagasse into a hammermill to reduce the remaining long fibers to fibers of a shorter length.

Third, removing the short fibers which are about $\frac{1}{4}$ to $\frac{3}{8}$ inch (6.35 to 9.53 mm) in length as they are created or generated in the hammermill.

The product consists essentially of short fibers of bagasse which are about $\frac{1}{4}$ to $\frac{3}{8}$ inch (6.35 to 9.53 mm) in length produced by the foregoing process.

DESCRIPTION OF THE PREFERRED EMBODIMENTS

As the crushed bagasse comes from the sugar mill, it is a mixture of short fibers, about $\frac{1}{4}$ to $\frac{3}{8}$ inch (6.35 to 9.53 mm) in length, and long fibers (that is, fibers that are more than about $\frac{3}{8}$ inch in length).

In practice, the bagasse is removed from the bagasse waste pile in a partially weathered or decomposed state. The weathered bagasse is partially defibered as a consequence of the crushing in the sugar mill and the decomposition in the waste pile and includes both shorter length $\frac{1}{4}$-$\frac{3}{8}$" fibers and a large proportion of longer length fibers ranging up to about 12".

My initial research in this field included running crushed bagasse as it comes from the sugar mill through a commercially-available hammermill in an attempt to produce a useful short fiber product. However, this effort was a failure. The hammermill transformed the bagasse into a paste-like material which rendered the hammermill completely ineffective. This inherent agglomerating build up or packing tendency of material in the hammermill is discussed in Steele (U.S. Pat. No. 3,241,587; col. 1, lines 17–25, and col, 3, line 72 to col. 4, line 3). Steele solved this problem by force feeding the material into the hammermill and forcing the finely divided, substantially homogeneous mass through the apertures of an extruding screen.

My solution to the problem is completely different in concept from Steele's force feeding process. I have discovered that by removing the short-length fibers in the crushed bagasse in a rotary screen separator and then feeding the so-screened bagasse through a hammermill having a $\frac{1}{4}$-$\frac{3}{8}$" screen and then removing the $\frac{1}{4}$-$\frac{3}{8}$" fiber particles as they are generated in the hammermill, it is possible to generate a peat moss-like short fiber product. Thus, by removing the $\frac{1}{4}$-$\frac{3}{8}$" fibers in the as-received bagasse prior to running the material through the hammermill, it is possible to generate a peat moss-like material having fibers between $\frac{1}{4}$ and $\frac{3}{8}$" in length without generating the undesirable paste-like material previously obtained.

No water is added to the bagasse as it is processed in the hammermill according to the present invention because adding water would create the undesirable paste-like material. Hence, my process is different in concept from Horton et al (U.S. Pat. Nos. 2,729,856 and 2,729,858) where water is added during processing.

Thus, the first step in the inventive process is to screen the bagasse as it comes from the sugar mill or from the bagasse pile and initially separate the existing short fibers from the long fibers. This step is accomplished preferably by means of a rotary screen separator as shown in FIG. 1.

Figure 1:
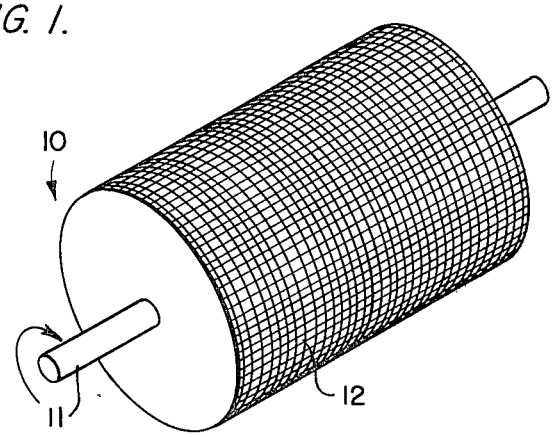
FIG. 1 is a perspective view of a rotary screen separator which may be used in one step of the inventive process.

In FIG. 1, rotary screen separator 10 includes shaft 11, which is rotated by a suitable power source, and screen 12. Screen 12 is made preferably of hardware cloth having $\frac{1}{4}$ to $\frac{3}{8}$ inch apertures. Bagasse is placed inside separator 10. As it rotates (rotation at 18 rpm has proved satisfactory), the short fibers ($\frac{1}{4}$-$\frac{3}{8}$") fall through screen 12 and are collected. The long fibers do not fall through and remain inside the separator 10.

Figure 2:
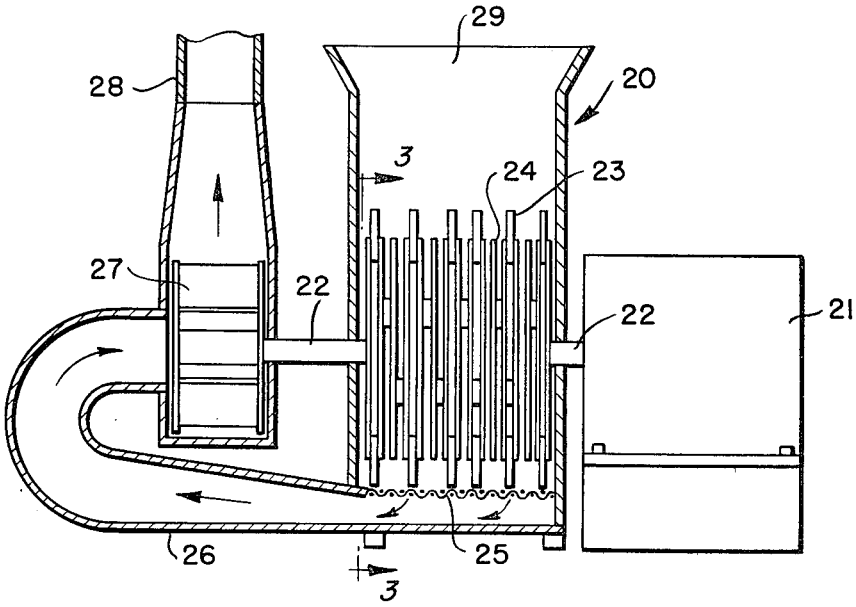
FIG. 2 is a longitudinal cross-sectional view of a hammermill with a fan or blower system which is used in another step of the inventive process.
Figure 3:
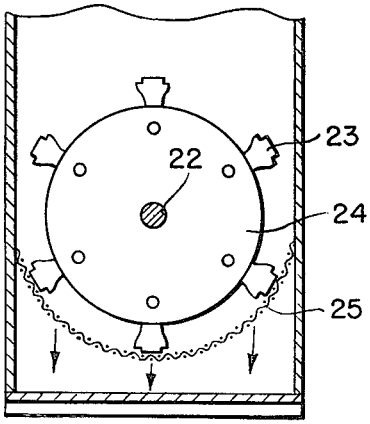
FIG. 3 is a transverse cross-sectional view of the hammermill taken along line 3—3 in FIG. 2.

In the next step of the inventive process, the long fibers are removed from separator 10 and fed into hammermill 20, as shown in FIGS. 2 and 3. A suitable hammermill is commerically available from Jay Bee Manufacturing Inc. of Tyler, Texas (Model #4W). The hammermill 20 is a high speed unit driven at 3200 rpm by motor 21 (150 horsepower).

The long fibers of the bagasse are fed in through feed inlet 29. Hammers 23 are pivotally-mounted on discs 24 which are rigidly secured to a mounting shaft 22 which is rotated by motor 21. The action of hammers 23 breaks up the existing long fibers thus creating or generating short fibers.

The final step of the process is to remove the short fibers from the hammermill 20. As the fibers become sufficiently short, they pass through a screen 25 (having $\frac{1}{4}$ to $\frac{3}{8}$ inch apertures) which is located in the lower portion of the hammermill 20 below the hammers 23. An air flow created by fan cage assembly 27 draws or pulls the short fibers through the apertures of screen 25. In this way, the short fibers of bagasse are removed without build up in hammermill 20.

After the short fibers pass through screen 25, they are drawn through suction pipe 26 into fan cage assembly 27 which is rotated by shaft 22. The short fibers are then blown through duct 28 into a collection bag. The short fibers collected from rotary screen separator 10 and the short fibers generated by hammermill 20 are added together. The product consists of short fibers of bagasse which are essentially about $\frac{1}{4}$ to $\frac{3}{8}$ inch (6.35 to 9.53 mm) in length.

The short fiber bagasse product is a good substitute for peat moss and is useful as a planting or potting soil. The product can be used in conjunction with other material (chemical nutrients, fertilizers, etc.) as is frequently done with peat moss.

Samples of bagasse and peat moss have the following chemical analysis (percentages by weight):

| Sample | % Nitrogen | % Phosphorous | % Potassium |
|---|---|---|---|
| Bagasse | 0.14 | 0.02 | 0.10 |
| Peat Moss | 0.60 | 0.05 | 0.05 |

The above-described embodiments are intended to be illustrative, not restrictive. The full scope of the invention is defined by the claims, and any and all equivalents are intended to be embraced.

I claim:

1. A process for reducing bagasse to a peat moss-like material useful as a planting or potting soil, comprising the steps of:

(1) screening the bagasse to remove existing short fibers which are about $\frac{1}{4}$ to $\frac{3}{8}$ inch (6.35 to 9.53 mm) in length;

(2) feeding the so-screened bagasse into a hammermill to reduce the remaining long fibers to fibers of a shorter length;

(3) removing the short fibers which are about $\frac{1}{4}$ to $\frac{3}{8}$ inch (6.35 to 9.53 mm) in length as they are generated in the hammermill; and, (4) combining the short fibers from steps (1) and (3), whereby a product consisting essentially of short fibers of bagasse which are about $\frac{1}{4}$ to 154 inch (6.35 to 9.53 mm) in length is produced.

2. The process of claim 1 wherein step (1) is performed in a rotary screen separator having a screen with apertures which are about $\frac{1}{4}$ to $\frac{3}{8}$ inch (6.35 to 9.53 mm).

3. The process of claim 1 wherein step (2) is performed in a hammermill having a screen with apertures which are about $\frac{1}{4}$ to $\frac{3}{8}$ inch (6.35 to 9.53 mm).

4. The process of claim 1 wherein step (3) is performed using an air flow created by a fan to collect the short fibers as they are generated in the hammermill.

5. The product consisting essentially of short fibers of bagasse which are about $\frac{1}{4}$ to $\frac{3}{8}$ inch (6.35 to 9.53 mm) in length produced by the process of claim 1.

* * * * *

UNITED STATES PATENT AND TRADEMARK OFFICE

CERTIFICATE OF CORRECTION

PATENT NO. : 4,304,361

DATED : December 8, 1981

INVENTOR(S) : George E. Campbell

It is certified that error appears in the above—identified patent and that said Letters Patent is hereby corrected as shown below:

In the claims, column 4, line 44, "154" should be --3/8--.

Signed and Sealed this

*Fourth* Day of *May 1982*

[SEAL]

*Attest:*

GERALD J. MOSSINGHOFF

*Attesting Officer*

*Commissioner of Patents and Trademarks*